US008497818B2

(12) United States Patent
Yang

(10) Patent No.: US 8,497,818 B2
(45) Date of Patent: Jul. 30, 2013

(54) PLASMA DISPLAY AND APPARATUS AND METHOD OF DRIVING THE PLASMA DISPLAY

(75) Inventor: Jin-Ho Yang, Suwon-si (KR)

(73) Assignee: Samsung SDI Co., Ltd., Gongse-dong, Giheung-gu, Yongin-si, Gyeonggi-do (KR)

( * ) Notice: Subject to any disclaimer, the term of this patent is extended or adjusted under 35 U.S.C. 154(b) by 899 days.

(21) Appl. No.: 11/898,375

(22) Filed: Sep. 11, 2007

(65) Prior Publication Data

US 2008/0067943 A1 Mar. 20, 2008

(30) Foreign Application Priority Data

Sep. 20, 2006 (KR) ..... 10-2006-0091024

(51) Int. Cl.
*G09G 3/28* (2006.01)

(52) U.S. Cl.
USPC ..... 345/60; 315/169.4

(58) Field of Classification Search
USPC ..... 345/60; 37/41; 315/169.1
See application file for complete search history.

(56) References Cited

U.S. PATENT DOCUMENTS

| | | | | |
|---|---|---|---|---|
| 4,866,349 | A | 9/1989 | Weber et al. | |
| 5,081,400 | A | 1/1992 | Weber et al. | |
| 6,653,993 | B1 | 11/2003 | Nagao et al. | |
| 7,379,033 | B2 | 5/2008 | Lee et al. | |
| 2003/0085886 | A1 * | 5/2003 | Ide et al. | 345/211 |
| 2004/0239592 | A1 * | 12/2004 | Okada | 345/63 |
| 2006/0279484 | A1 | 12/2006 | Ikeda | |
| 2007/0195016 | A1 | 8/2007 | Okada | |

FOREIGN PATENT DOCUMENTS

| | | | |
|---|---|---|---|
| CN | 1650339 | A | 8/2005 |
| CN | 1746944 | | 3/2006 |
| EP | 1376524 | A | 2/2004 |
| JP | 11282416 | | 10/1999 |
| JP | 2000148083 | | 5/2000 |
| JP | 2001056666 | | 2/2001 |
| JP | 2003076321 | | 3/2003 |
| JP | 2003233343 | | 8/2003 |
| JP | 2004037538 | | 2/2004 |

(Continued)

OTHER PUBLICATIONS

Cited in the extended European search report dated Sep. 4, 2009, of the corresponding European Patent Application No. 0711667.2.

(Continued)

*Primary Examiner* — Kevin M Nguyen
*Assistant Examiner* — Kenneth B Lee, Jr.
(74) *Attorney, Agent, or Firm* — Robert E. Bushnell, Esq

(57) ABSTRACT

A plasma display supplies a high level voltage and a low level voltage to first and second electrodes performing a sustain discharge in opposite phases during a sustain period. After a voltage of the first electrodes is decreased through a first inductor connected to the first electrodes, the first electrodes are floated to maintain the voltage of the first electrodes at a second voltage. Then, while the voltage of the first electrodes is changed from the second voltage to a low level voltage, the magnitude of the current flowing through a second inductor connected to the second electrodes is increased. Then, the voltage of the second electrodes is increased to a high level voltage using the second inductor. After energy is accumulated in the second inductor, the voltage of the second electrode is increased to the high level voltage.

18 Claims, 9 Drawing Sheets

FOREIGN PATENT DOCUMENTS

| | | |
|---|---|---|
| JP | 2004226915 | 8/2004 |
| JP | 2005165262 | 6/2005 |
| KR | 2004-0010769 | 1/2004 |

OTHER PUBLICATIONS

Chinese Office action issued by SIPO on Jan. 4, 2012, corresponding to Patent No. ZL 200710153467.X and its English Translation attached herewith.

Japanese Notice of Allowance issued Apr. 10, 2012 in connection with Japanese Patent Application Serial No. 2007-062072, which also claims Korean Patent Application Serial No. 10-2006-0091024 as its priority document, and Request for Entry of the Accompanying Office Action attached herewith.

EPO OA issued by EPO on Mar. 19, 2013 of the corresponding EP Patent Application No. 07116667.2.

* cited by examiner

PLASMA DISPLAY AND APPARATUS AND METHOD OF DRIVING THE PLASMA DISPLAY

CLAIM OF PRIORITY

This application makes reference to, incorporates the same herein, and claims all benefits accruing under 35 U.S.C.§119 from an application for PLASMA DISPLAY AND APPARAT US AND METHOD OF DRIVING THE SAME earlier filed in the Korean Intellectual Property Office on Sep. 20, 2006 and there duly assigned Serial No. 10-2006-0091024.

BACKGROUND OF THE INVENTION

1. Field of the Invention

The present invention relates to a plasma display, and an apparatus and method of driving the plasma display. More particularly, the present invention relates to a sustain discharge circuit for a plasma display.

2. Description of the Related Art

A plasma display is a display using a Plasma Display Panel (PDP) that uses a plasma generated by a gas discharge to display characters or images. In the PDP, a plurality of discharge cells are arranged in a matrix.

In general, the plasma display is driven by dividing one field into a plurality of subfields, and grayscales are displayed by a combination of weight values of subfields among the plurality of subfields, in which a display operation is performed. During an address period of each subfield, cells are selected to be turned on and not to be turned on. During a sustain period, a sustain discharge is performed on the cells to be turned on so as to display images.

In order to perform these operations, a high level voltage and a low level voltage are alternately supplied to electrodes performing the sustain discharge during the sustain period. Since two electrodes where the sustain discharge is generated serve as capacitive components, a reactive power is required to supply a high level voltage and a low level voltage to the electrodes. Accordingly, as a sustain discharge circuit of a plasma display, an energy recovery circuit that recovers and reuses reactive power is generally used. As an example of an energy recovery circuit according to the related art, there is an energy recovery circuit (U.S. Pat. Nos. 4,866,349 and 5,081,400) suggested by L. F. Weber. However, according to the energy recovery circuit according to the related art, an energy recovery ratio is lowered due to a voltage drop of a switch, a voltage drop of a diode, a leakage component of an inductor, and a parasitic leakage resistance in a circuit.

SUMMARY OF THE INVENTION

The present invention has been made in an effort to provide a plasma display, and an apparatus and method of driving the plasma display, having advantages of improving an energy recovery ratio of a sustain discharge circuit.

An exemplary embodiment of the present invention provides a method of driving a plasma display having first and second electrodes. The method includes decreasing a voltage of the first electrodes from a first voltage, maintaining the voltage of the first electrodes at a second voltage smaller than the first voltage, increasing the magnitude of a current flowing through a first inductor connected to the second electrodes while changing the voltage of the first electrodes to a third voltage smaller than the second voltage from the second voltage, and increasing a voltage of the second electrodes through the first inductor while supplying the third voltage to the first electrodes.

Another embodiment of the present invention provides a plasma display that includes a Plasma Display Panel (PDP) having first and second electrodes and performing a display operation, and a driving circuit that includes a first inductor connected to the first electrodes and a second inductor connected to the second electrodes, and supplies a first voltage and a second voltage smaller than the first voltage to the respective first and second electrodes in opposite phases during a sustain period. The driving circuit accumulates energy in the second inductor while changing a voltage of the first electrodes to the second voltage from a third voltage smaller than the first voltage during a first period, and accumulates energy in the first inductor while changing a voltage of the second electrodes to the second voltage from a fourth voltage smaller than the first voltage during a second period.

Yet another embodiment of the present invention provides an apparatus to drive a plasma display including first and second electrodes and performing a display operation. The apparatus includes a first transistor connected between a first power supply supplying a first voltage and the first electrodes, a second transistor connected between a second power supply supplying a second voltage smaller than the first voltage and the first electrodes, a first inductor having a first terminal connected to the first electrodes; a third transistor connected between a second terminal of the first inductor and a third power supply supplying a third voltage between the first voltage and the second voltage, and forming a path decreasing the voltage of the first electrodes when turned on, a second inductor having a first terminal connected to the second electrodes, and a fourth transistor connected between a second terminal of the second inductor and a fourth power supply supplying a fourth voltage between the first voltage and the second voltage, and forming a path increasing the voltage of the second electrodes when turned on. When a fifth voltage smaller than the third voltage is supplied to the first electrodes, the fourth transistor is turned on during a first period when the voltage of the first electrodes is changed to the first voltage.

Another embodiment of the present invention provides a method of driving a plasma display including first and second electrodes. The method includes increasing a voltage of the second electrodes to a second voltage larger than a first voltage through a first inductor connected to the second electrodes when a voltage of the first electrodes is maintained at the first voltage, accumulating energy in a second inductor connected to the first electrodes while decreasing the voltage of the second electrodes to the first voltage from the second voltage, increasing the voltage of the first electrodes to a third voltage through the second inductor when the voltage of the second electrodes is maintained at the first voltage, decreasing the voltage of the first electrodes to a fourth voltage larger than the first voltage from the third voltage through the second inductor when the voltage of the second electrodes is maintained at the first voltage, accumulating energy in the first inductor connected to the second electrodes while decreasing the voltage of the first electrodes to the first voltage from the fourth voltage, and increasing the voltage of the second electrodes to the third voltage through the first inductor when the voltage of the first electrodes is maintained at the first voltage.

BRIEF DESCRIPTION OF THE DRAWINGS

A more complete appreciation of the present invention and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
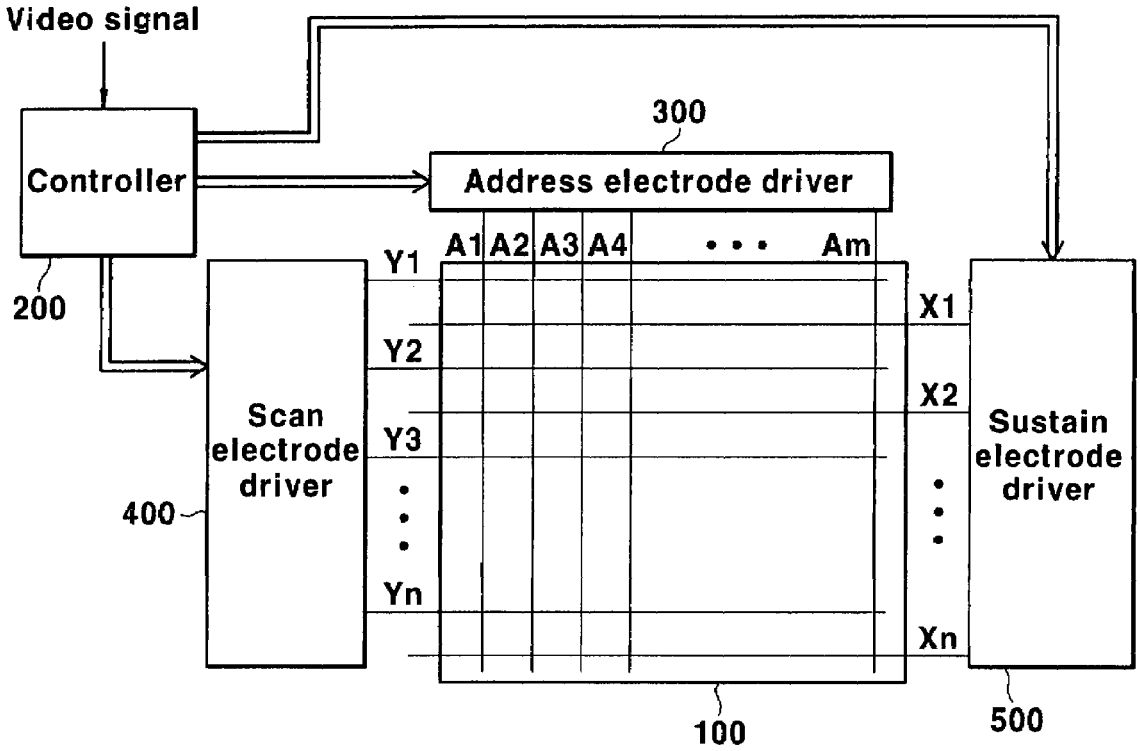
FIG. 1 is a view of a plasma display according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention.

Accordingly, the drawings and description are to be regarded as illustrative in nature and not restrictive. Like reference numerals designate like elements throughout the specification. It will be understood that when an element or layer is referred to as being "connected to" or "coupled to" another element or layer, it can be directly connected or coupled to the other element or layer or intervening elements or layers may be present.

A plasma display, an apparatus for driving the same, and a method of driving the plasma display according to an exemplary embodiment of the present invention is described as follows with reference to the accompanying drawings.

Figure 2:
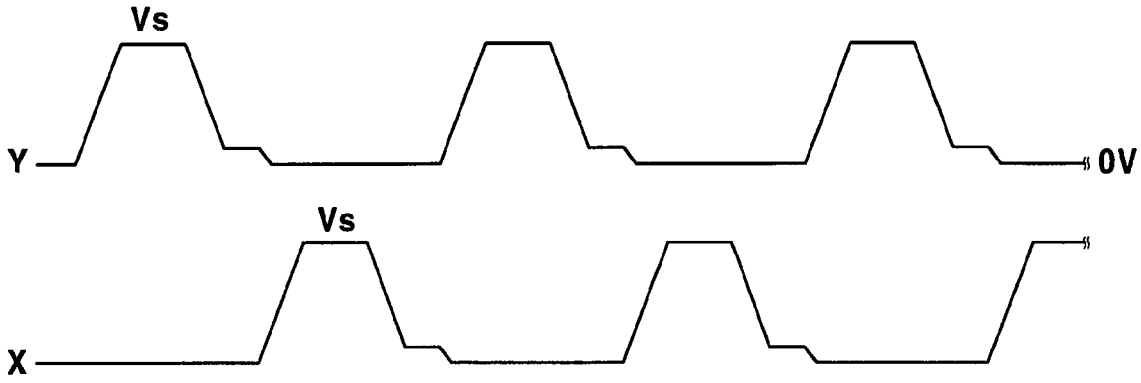
FIG. 2 is a view of driving waveforms of a plasma display according to an exemplary embodiment of the present invention.

FIG. 1 is a view of a plasma display according to an exemplary embodiment of the present invention, and FIG. 2 is a view of driving waveforms of a plasma display according to an exemplary embodiment of the present invention.

As shown in FIG. 1, a plasma display according to an exemplary embodiment of the present invention includes a Plasma Display Panel (PDP) 100, a controller 200, an address electrode driver 300, a scan electrode driver 400, and a sustain electrode driver 500.

The plasma PDP 100 includes a plurality of address electrodes (hereinafter referred to as A electrodes) A1 to Am that extend in a column direction, and a plurality of sustain electrodes (hereinafter referred to as X electrodes) X1 to Xn and a plurality of scan electrodes (hereinafter referred to as Y electrodes) Y1 to Yn that extend in a row direction while forming pairs. Generally, the X electrodes X1 to Xn are formed so as to correspond to the Y electrodes Y1 to Yn, and the X electrodes X1 to Xn and the Y electrodes Y1 to Yn perform a display operation to display images during a sustain period. The Y electrodes Y1 to Yn and the X electrodes X1 to Xn are disposed to cross the A electrodes A1 to Am. Discharge spaces disposed at intersections of the A electrodes A1 to Am and the X and Y electrodes X1 to Xn and Y1 to Yn form cells. The structure of the PDP 100 is just an example, and panels having different structures to which the following driving waveforms can be supplied may be supplied to the present invention.

The controller 200 receives an external video signal, and outputs an A electrode driving control signal, an X electrode driving control signal, and a Y electrode driving control signal. The controller 200 divides one frame into a plurality of subfields and drives the divided subfields, and each of the subfields includes a reset period, an address period, and a sustain period, when it is represented by the temporal operation variation.

The address electrode driver 300 receives the A electrode driving control signal from the controller 200, and supplies data signals for selecting discharge cells to be displayed to the A electrodes.

The scanning electrode driver 400 receives the Y electrode driving control signal from the controller 200 and supplies a driving voltage to the Y electrodes.

The sustain electrode driver 500 receives the X electrode driving control signal from the controller 200, and supplies a driving voltage to the X electrodes.

Specifically, during an address period of each subfield, address electrode, scan electrode and sustain electrode drivers 300, 400, and 500 select discharge cells to be turned on and discharge cells to be turned off in a corresponding subfield from among a plurality of discharge cells. During a sustain period of each subfield, as shown in FIG. 2, the scan electrode driver 400 supplies sustain pulses alternately having a high level voltage Vs or a low level voltage 0 V to the plurality of Y electrodes Y1 to Yn by the number of times according to a weight value of the corresponding subfield. In addition, the sustain electrode driver 500 supplies a sustain pulse to a plurality of X electrodes X1 to Xn in a phase opposite to that of the sustain pulse supplied to the Y electrodes Y1 to Yn. The voltage difference between the Y electrode and the X electrode is alternately a voltage of Vs and a voltage of −Vs. Therefore, in discharge cells to be turned on, a sustain discharge is repeatedly generated a predetermined number of times.

In addition, during a sustain period, the controller 200 sets intervals of time such that an interval of time T2 when the voltage of the plurality of Y electrodes Y1 to Yn is decreased from a high level voltage Vs to a low level voltage 0 V is longer than an interval of time T1 when the voltage of the plurality of Y electrodes Y1 to Yn is increased from the low level voltage 0 V to the high level voltage Vs. Similarly, the controller 200 sets intervals of time such that an interval of time T4 when the voltage of the plurality of Y electrodes Y1 to Yn is decreased from the high level voltage Vs to the low level voltage 0 V is longer than an interval of time T3 when the voltage of the plurality of Y electrodes Y1 to Yn is increased from the low level voltage 0 V to the high level voltage Vs.

A sustain discharge circuit that supplies a sustain pulse of FIG. 2 is described in detail as follows with reference to FIG. 3.

Figure 3:
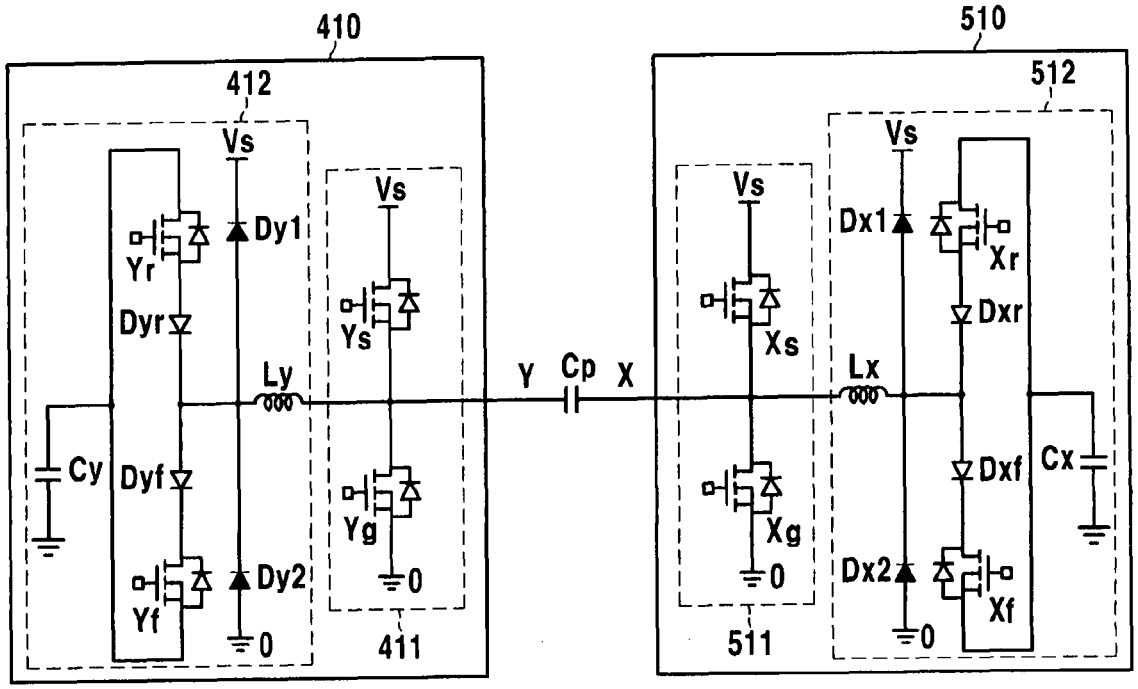
FIG. 3 is a schematic view of a sustain discharge circuit of a plasma display according to an exemplary embodiment of the present invention.

FIG. 3 is a schematic view of a sustain discharge circuit according to an exemplary 5 embodiment of the present invention. In FIG. 3, for the sake of better understanding and ease of description, one X electrode X and one Y electrode Y are shown, and a capacitive component that is formed by the X electrode X and the Y electrode Y is shown by a panel capacitor Cp. In FIG. 3, each of the transistors Ys, Yr, Yf, Yg, Xs, Xr, Xf, and Xg is composed of an n-channel field effect transistor, particularly, an N-channel Metal Oxide semiconductor (NMOS) transistor. In each of the transistors Ys, Yr, Yf, Yg, Xs, Xr, Xf, and Xg, a body diode may be formed in a direction toward a drain from a source. In addition, instead of the NMOS transistor, other transistors having a function similar to that of the NMOS transistor may be used for the transistors Ys, Yr, Yf, Yg, Xs, Xr, Xf, and Xg. In FIG. 3, each of transistors Ys, Yr, Yf, Yg, Xs, Xr, Xf, and Xg is composed of one transistor, but each of the transistors Ys, Yr, Yf, Yg, Xs, Xr, Xf, and Xg may include a plurality of transistors that are connected in parallel to one another.

As shown in FIG. 3, the sustain discharge circuit of the plasma display according to the exemplary embodiment of the present invention includes the Y electrode sustain discharge circuit 410 and the X electrode sustain discharge circuit 510. The Y electrode sustain discharge circuit 410 is connected to the plurality of Y electrodes Y1 to Yn, and is included in the scan electrode driver 400 of FIG. 1. The X electrode sustain discharge circuit 510 is connected to the plurality of X electrodes X1 to Xn, and is included in the sustain electrode driver 500 of FIG. 1.

The Y electrode sustain discharge circuit 410 includes a sustain discharge unit 411 and an energy recovery unit 412. The sustain discharge unit 411 includes transistors Ys and Yg, and may supply a voltage of Vs or a voltage of 0 V to the Y electrode through switching operations of the transistors Ys and Yg. The energy recovery unit 412 includes transistors Yr and Yf, an inductor Ly, a capacitor Cy, and diodes Dyr, Dyf, Dy1, and Dy2, and charges a voltage of the Y electrode of the panel capacitor Cp with a voltage of Vs by using a resonance of the inductor Ly and the panel capacitor Cp, or discharges it with the voltage of 0 V. In the Y electrode sustain discharge circuit 410, a drain of the transistor Ys is connected to a high level voltage Vs, and a source of the transistor Ys is connected to the Y electrode. A source of the transistor Yg is connected to a power supply (i.e., ground terminal) supplying a low level voltage 0 V, and a drain of the transistor Yg is connected to the Y electrode. A first terminal of the inductor Ly is connected to the Y electrode, and a cathode of the diode Dyr and an anode of the diode Dyf are connected to a second terminal of the inductor Ly. A source of the transistor Yr is connected to an anode of the diode Dyr, and a drain of the transistor Yf is connected to a cathode of the diode Dyf. In addition, a drain of the transistor Yr and a source of the transistor Yf are connected to the capacitor Cy that serves as a power source for energy recovery. The capacitor Cy supplies a voltage between a high level voltage Vs and a low level voltage 0 V, more particularly, the capacitor Cy supplies an average value Vs/2between two voltages Vs and 0 V. In addition, the diode Dyr sets a current path to increase a voltage of the Y electrode, and the diode Dyf sets a current path to decrease a voltage of the Y electrode. If the transistors Yr and Yf do not have body diodes, the diodes Dyr and Dyf may be removed. In addition, the locations between the diode Dyr and the transistor Yr may be reversed, and the locations between the diode Dr and the transistor Yf may be reversed. In addition, diodes Dy1 and Dy2 that clamp a potential at the second terminal of the inductor Ly may be respectively formed between the high level voltage Vs and the second terminal of the inductor Ly, and between a ground terminal and the second terminal of the inductor Ly.

Referring to FIG. 3 again, the X electrode sustain discharge circuit 510 includes a sustain discharge unit 511 and an energy recovery unit 512. The sustain discharge unit 511 includes transistors Xs and Xg, and supplies a voltage of Vs or a voltage of 0 V to the X electrode through switching operations of the transistors Xs and Xg. The energy recovery unit 512 includes transistors Xr and Xf, an inductor Lx, a capacitor Cx, and diodes Dxr, Dxf, Dx1, and Dx2, and charges a voltage of the X electrode of the panel capacitor Cp with a voltage Vs by using a resonance of the inductor Lx and the panel capacitor Cp, or discharges it with the voltage 0 V. In the X electrode sustain discharge circuit 510, a drain of the transistor Xs is connected to the high level voltage Vs, and a source of the transistor Xs is connected to the X electrode. A source of the transistor Xg is connected to a power supply (i.e., ground terminal) supplying a low level voltage 0 V, and a drain of the transistor Xg is connected to the X electrode. A first terminal of the inductor Lx is connected to the X electrode, and a second terminal of the inductor Lx is connected to a cathode of the diode Dxr and an anode of the diode Dxf. A source of the transistor Xr is connected to an anode of the diode Dxr, and a drain of the transistor Xf is connected to a cathode of the diode Dxf. In addition, a drain of the transistor Xr and a source of the transistor Xf are connected to the capacitor Cx that is a power supply for energy recovery. The capacitor Cx supplies a voltage between a high level voltage Vs and a low level voltage 0 V, more particularly, the capacitor Cx supplies an average voltage Vs/2 between two voltages Vs and 0 V. In addition, the diode Dxr sets a current path to increase a voltage of an X electrode, and the diode Dxf sets a current path to decrease a voltage of an X electrode. If the transistors Xr and Xf do not have body diodes, the diodes Dxr and Dxf may be removed. In addition, the locations between the diode Dxr and the transistor Xr may be reversed, and the locations between the diode Dr and the transistor Xf may be reversed. In addition, diodes Dx1 and Dx2 that clamp a potential at the second terminal of the inductor Lx may be respectively formed between the high level voltage Vs and the second terminal of the inductor Lx, and between a ground terminal and the second terminal of the inductor Lx.

The operation of the sustain discharge circuit of the plasma display of FIG. 3 is described as follows with reference to FIGS. 4, and 5A to 5F.

Figure 4:
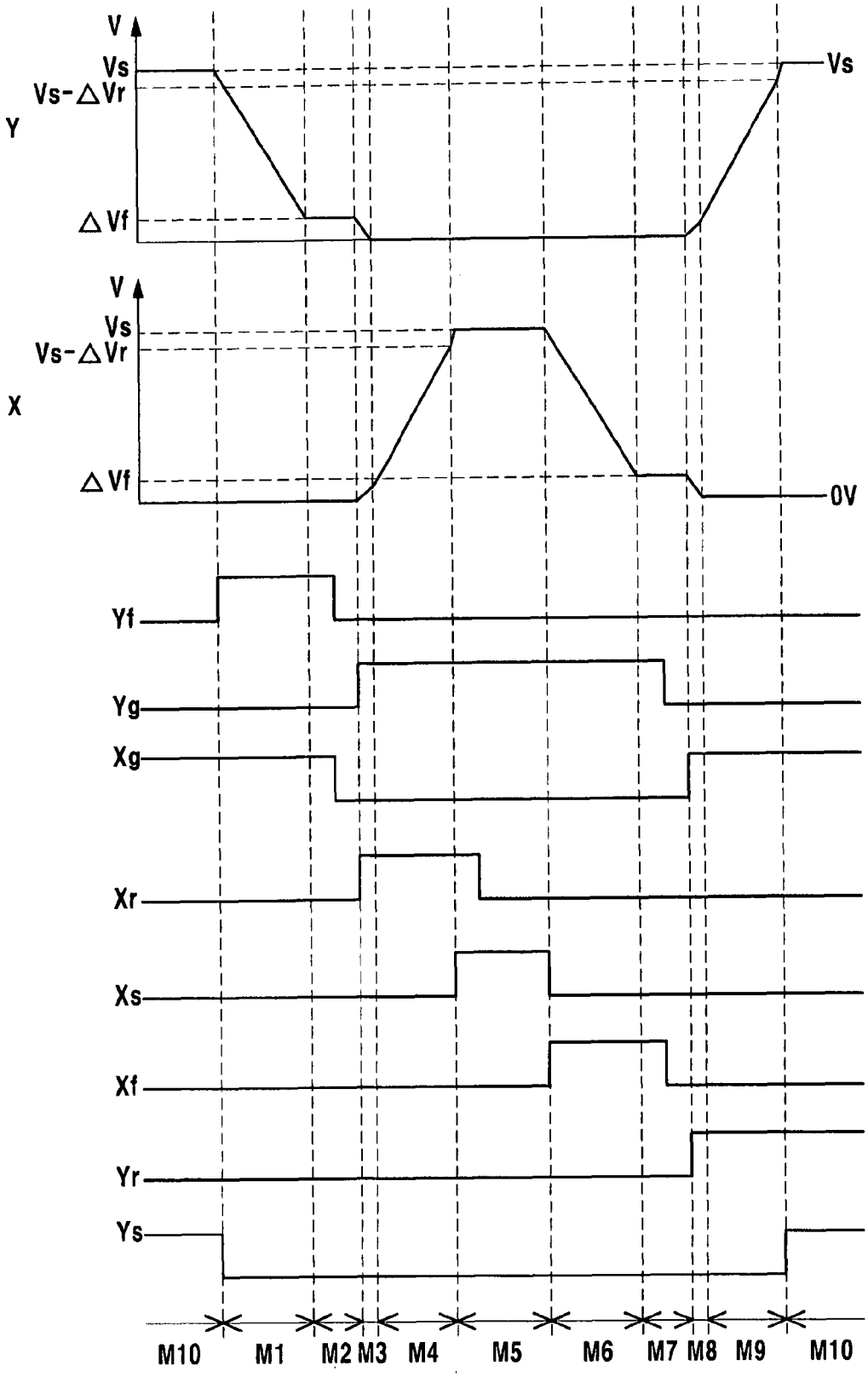
FIG. 4 is a signal timing chart according to an exemplary embodiment of a sustain discharge circuit of the plasma display of FIG. 3.

FIG. 4 is a signal timing chart according to an exemplary embodiment of a sustain discharge circuit of a plasma display of FIG. 3, and FIGS. 5A to 5F are views to explain the operation of the sustain discharge circuit 510 of the plasma display of FIG. 3 according to the signal timing of FIG. 4. First, it is assumed that in a mode 10 M10 right before a mode 1 M1 of FIG. 4,the transistors Ys and Xg are turned on, a voltage Vs is supplied to the Y electrode, and a voltage 0 V is supplied to the X electrode.

Figure 5A:
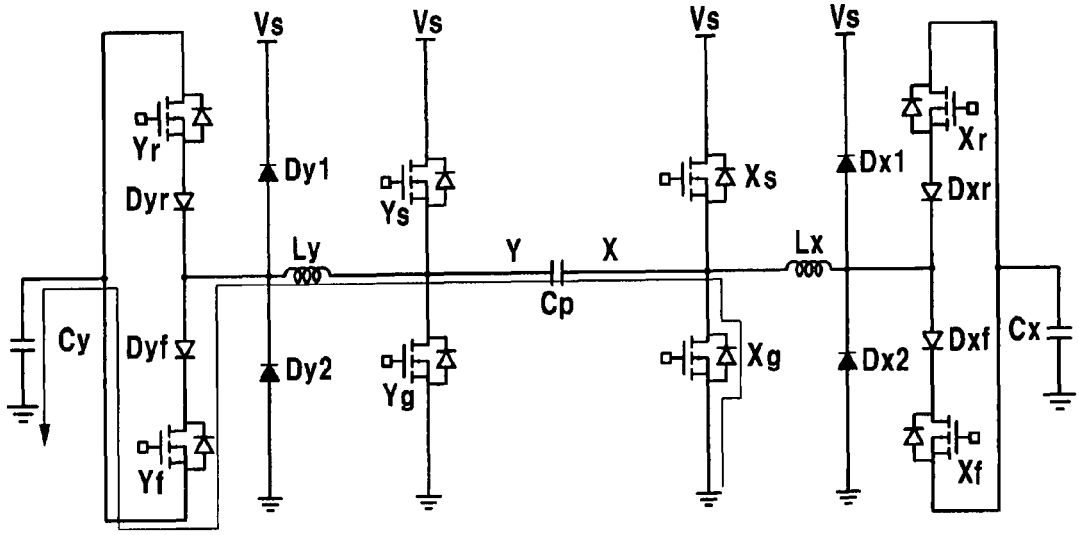
FIGS. 5A to 5F are views to explain the operation of a sustain discharge circuit 510 of the plasma display of FIG. 3 according to the signal timing of FIG. 4.

①Mode 1 M1 (see FIG. 5A)

In the mode 1 M1 of FIG. 4, when the transistor Yg is turned on, the transistor Yf is turned on. As a result, when the voltage of the X electrode is maintained at the voltage 0 V, as shown in FIG. 5A, a current path is formed through a ground terminal, a body diode of the transistor Xg, a panel capacitor Cp, an inductor Ly, a diode Dyf, a transistor Yf, and a capacitor Cy. A resonance occurs between the panel capacitor Cp and the inductor Ly. Due to the resonance, the voltage of the Y electrode is decreased from the voltage Vs while energy stored in the panel capacitor Cp is recovered to the capacitor Cy through the inductor Ly. Although the voltage of the Y electrode is ideally reduced to the voltage 0 V due to the resonance, the voltage of the Y electrode is reduced to a voltage ΔVf larger than a voltage 0 V due to a voltage drop of the transistor Yf, a voltage drop of a diode Dyf, a leakage component of the inductor Ly, and a parasitic component of the circuit.

②Mode 2 M2 (see FIG. 5A)

In the mode 2 M2 of FIG. 4, after the transistor Yf is turned on during a predetermined period, the Y electrode enters a floating state. As a result, a voltage of the Y electrode is maintained at the voltage ΔVf. ③(Mode 3 M3 (see FIG. 5B)

In the mode 3 M3 of FIG. 4, the transistors Yg and Xr are turned on. As a result, a current path is formed through the capacitor Cx, the transistor Xr, the diode Dxr, the inductor Lx, the panel capacitor Cp, the transistor Yg, and the ground terminal. The voltage of the Y electrode is decreased with a predetermined slope from the voltage ΔVf to a voltage 0 V due to impedance in a path of the panel capacitor Cp, the transistor Yg, and the ground terminal. As such, while the voltage of the Y electrode is decreased from the voltage ΔVf to the voltage 0 V, a current is supplied to the X electrode through a path of the capacitor Cx, the transistor Xr, the diode Dxr, the inductor Lx, and the panel capacitor Cp. However, the voltage of the X electrode is rarely increased. Specifically, since the panel capacitor Cp exists between the X electrode and the Y electrode, a current of ΔVf×Cp is supplied to the X electrode while the voltage of the Y electrode is decreased by ΔVf, such that the voltage of the X electrode can be maintained without being changed. If the current is not supplied to the X electrode, a voltage of the X electrode is also reduced by a reduced voltage in the Y electrode. If the amount of current supplied to the X electrode through the inductor Lx is larger than the current ΔVf×Cp, the voltage of the X electrode is increased by the difference between the two currents in the last of the mode 3 M3. Accordingly, if the amount of the current supplied to the X electrode through the inductor Lx is not large, the voltage of the X electrode is rarely increased, but is maintained.

As such, since a voltage across the inductor Lx is maintained with the voltage rarely changed, a current flowing through the inductor Lx is increased, as represented by Equation 1.

$$I_{Lx} = \frac{V_{ERC}}{Lx}\Delta T1 \qquad \text{Equation 1}$$

In Equation 1, $V_{ERC}$ is a voltage charged in the Cx, and ΔT1 is a time of the mode 3 M3.

Figure 5B:
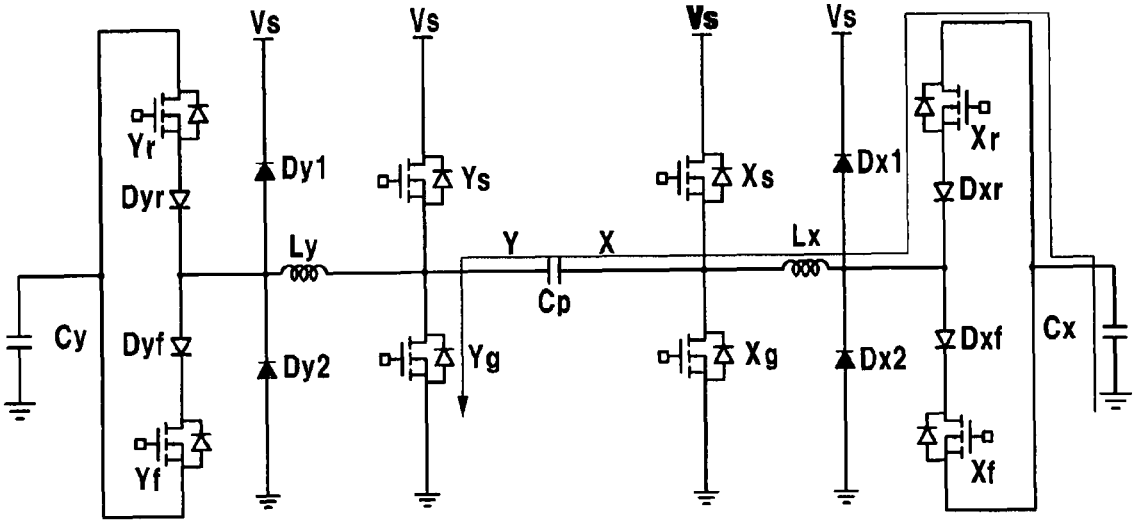

④Mode 4 M4 (see FIG. 5B)

In the mode 4 M4 of FIG. 4, the turned-on state of the transistors Yg and Xr are maintained, as in the mode 3 M3. A resonance occurs between the panel capacitor Cp and the inductor Lx. Due to the resonance, the energy charged in the capacitor Cx is supplied to the X electrode through the inductor Lx, and the voltage of the X electrode is increased from the voltage 0 V to the voltage Vs−Δvr.

That is, when the mode 4 M4 begins while the current is supplied to the X electrode through a path of the capacitor Cx, the transistor Xr, the diode Dxr, the inductor Lx, and the panel capacitor Cp in the mode 3 M3, the current flowing through the inductor Lx has an initial value represented by Equation 1. Similarly, since the resonance occurs in a state where the inductor Lx has the energy, the voltage of the X electrode can be increased to a voltage larger than the voltage when resonance occurs in a state where the inductor Lx does not have the energy. Therefore, an energy recovery ratio can be increased, as compared with the related art. That is, even when a parasitic component exists in the circuit, the voltage can be sufficiently increased to substantially the voltage Vs. The term ΔVr indicates a voltage drop value of the X electrode due to the parasitic component of the path in a state where the inductor Lx has the energy, and is smaller than a voltage drop value of the X electrode due to the parasitic component of the path in a state where the inductor Lx does not have the energy.

Figure 5C:
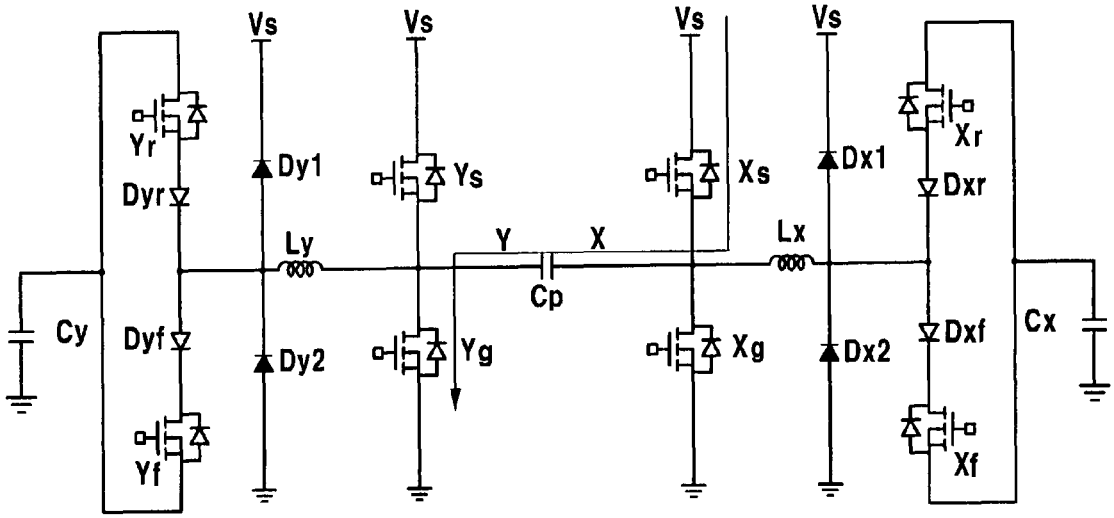

⑤Mode 5 M5 (see FIG. 5C)

In the mode 5 M5 of FIG. 4, when the transistor Yg is turned on, the transistor Xs is turned on, and the transistor Xr is turned off. As a result, a current path is formed through the power supply Vs, the transistor Xs, the panel capacitor Cp, the transistor Yg, and the ground terminal. Accordingly, the voltage Vs is supplied to the X electrode.

Figure 5D:
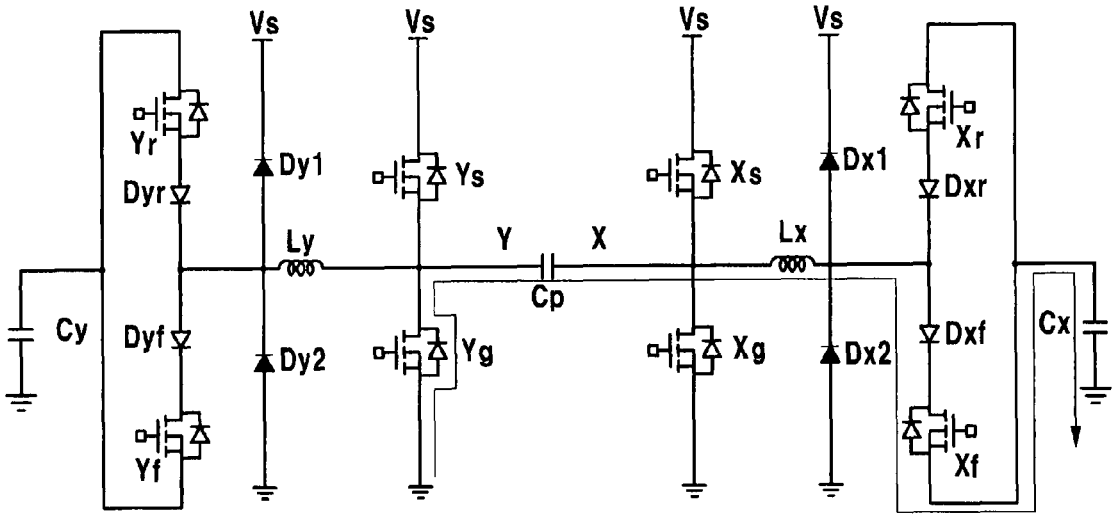

⑥Mode 6 M6 (see FIG. 5D)

In the Mode 6 M6 of FIG. 4, when the transistor Yg is turned on, the transistor Xf is turned on, and the transistor Xs is turned off. As a result, a current path is formed through the ground terminal, the body diode of the transistor Yg, the panel capacitor Cp, the inductor Lx, the diode Dxf, the transistor Xf, and the capacitor Cx. A resonance occurs between the panel capacitor Cp and the inductor Lx. Due to the resonance, the voltage of the X electrode is decreased from the voltage Vs, while the energy stored in the panel capacitor Cp is recovered to the capacitor Cx through the inductor Lx. Although the voltage of the X electrode is ideally reduced to the voltage 0 V due to the resonance, the voltage of the X electrode is reduced to a voltage ΔVf larger than a voltage 0 V due to a voltage drop of the transistor Xf, a voltage drop of the diode Dxf, a leakage component of the inductor Lx, and the parasitic component of the circuit.

⑦Mode 7 M7 (see FIG. 5D)

In the mode 7 M7 of FIG. 4, after the turned-on state of the transistors Yg and Yf in the mode 1 Ml is maintained during a predetermined period, the X and Y electrodes enter a floating state. Then, the voltage of the X electrode is maintained to the voltage ΔVf, and the voltage of the Y electrode is maintained to the voltage 0 V.

Figure 5E:
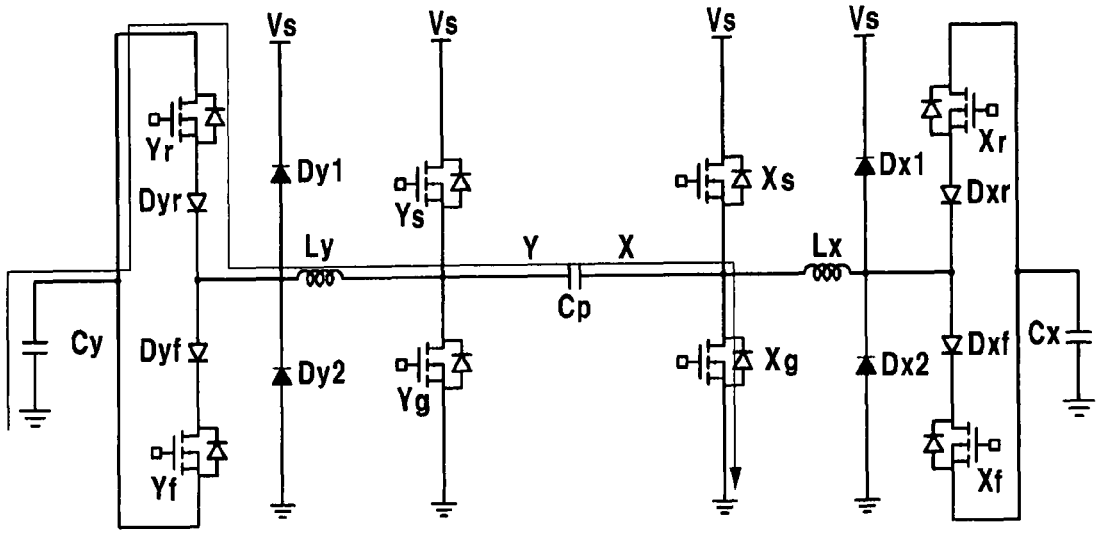

⑧Mode 8 M8 (see FIG. 5E)

In the mode 8 M8 of FIG. 4, the transistors Yr and Xg are turned on. As a result, a current path is formed through the capacitor Cy, the transistor Yr, the diode Dyr, the inductor Ly, the panel capacitor Cp, the transistor Xg, and ground terminal. The voltage of the X electrode is decreased with a predetermined slope from the voltage ΔVf to a voltage 0 V due to impedance in a path of the panel capacitor Cp, the transistor Xg, and the ground terminal. As such, while the voltage of the X electrode is decreased from the voltage ΔVf to the voltage 0 V, a current is supplied to the Y electrode through a path of the capacitor Cy, the transistor Yr, the diode Dyr, the inductor Ly, and the panel capacitor Cp. However, the voltage of the Y electrode is rarely increased. Specifically, because of the panel capacitor Cp between the X electrode and the Y electrode, a current of ΔVf×Cp is supplied to the Y electrode while the voltage of the X electrode is decreased by the voltage ΔVf, such that the voltage of the Y electrode can be maintained without being changed. If the current is not supplied to the X electrode, a voltage of the Y electrode is also reduced by a reduced voltage in the X electrode. If the amount of current supplied to the Y electrode through the inductor Ly is larger than the current ΔVf×Cp, the voltage of the Y electrode is increased by the difference between the two currents in the last of the mode 8 M8. Accordingly, if the amount of current supplied to the inductor Ly is not large, the voltage of the Y electrode is maintained with the voltage rarely increased.

As such, since a voltage across the inductor Ly is maintained with the voltage rarely changed, a current flowing through the inductor Ly is increased, as represented by Equation 2.

$$I_{Ly} = \frac{V_{ERC}}{Ly}\Delta T2 \qquad \text{Equation 2}$$

In Equation 2, $V_{ERC}$ is a voltage charged in the Cy, and ΔT2 is a time of the mode 8 M8.

⑨Mode 9 M9 (see FIG. 5E)

In the mode 9 of FIG. 4, the turned-on state of the transistors Yr and Xg is maintained, as in the mode 8 M8. A resonance occurs between the panel capacitor Cp and the inductor Ly. Due to the resonance, the energy charged in the capacitor Cy is supplied to the Y electrode through the inductor Ly, and the voltage of the Y electrode is increased from the voltage 0 V to the voltage Vs−Δvr.

That is, when a mode 9 M9 begins while the current is supplied to the Y electrode through a path of the capacitor Cy, the transistor Yr, the diode Dyr, the inductor Ly, and the panel capacitor Cp in the mode 8 M8, the current flowing through the inductor Ly has an initial value represented by Equation 2. Similarly, since the resonance occurs in a state where the inductor Lx has the energy, the voltage of the Y electrode can be increased to a voltage larger than the voltage when resonance occurs in a state where the inductor Ly has the energy. Therefore, an energy recovery ratio can be increased, as compared with the related art. That is, even when the parasitic component exists in the circuit, the voltage can be sufficiently increased to substantially the voltage Vs. The term ΔVr indicates a voltage drop value of the Y electrode due to the parasitic component of the path in a state where the inductor Ly has the energy, and it is smaller than a voltage drop value of the Y electrode due to the parasitic component of the path in a state where the inductor Ly does not have the energy.

According to the structure shown in FIG. 4, a voltage drop value of the Y electrode due to the parasitic component of the path in a state where the inductor Ly has the energy is the same as a voltage drop value of the X electrode due to the parasitic component of the path in a state where the inductor Lx has the energy. However, the two voltage drop values may be different due to the voltage drop of the transistors Xr and Yr, the voltage drop of the diodes Dxr and Dyr, and the leakage components of the inductors Lx and Ly.

Figure 5F:
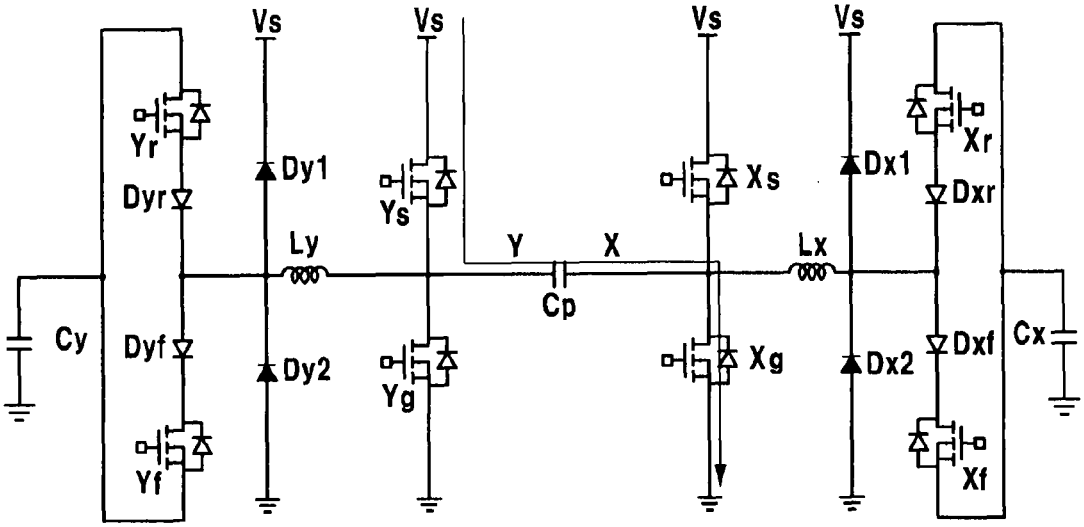

⑩ Mode 10 M10 (FIG. 5F)

In the mode M10 of FIG. 4, when the transistor Xg is turned on, the transistor Ys is turned on, and the transistor Yr is turned off. As a result, a current path is formed through the power supply Vs, the transistor Ys, the panel capacitor Cp, the transistor Xg, and the ground terminal. Accordingly, the voltage Vs is supplied to the Y electrode.

In addition, in the plasma display, during the sustain period, the sustain discharge circuit repeatedly performs the operations of the modes 1 to 10 M1 to M10 by the number of times according to a weight value of the corresponding subfield, and supplies a sustain pulse having alternately the voltage 0 V and the voltage Vs to the Y electrode and supplies a sustain pulse alternately having the voltage 0 V and the voltage Vs to the X electrode with a phase opposite to that of the sustain pulse supplied to the Y electrode.

Figure 6:
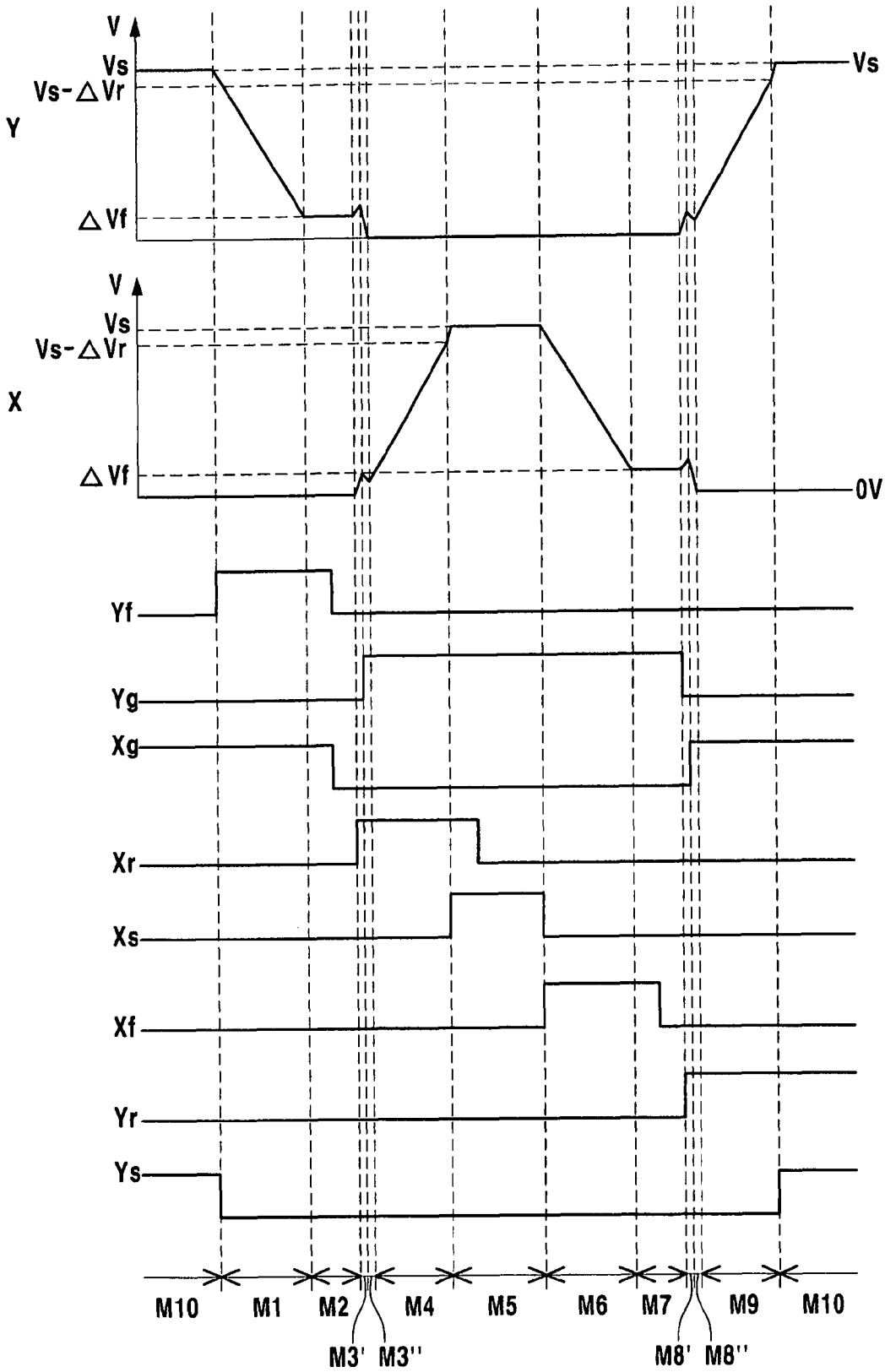
FIG. 6 is a signal timing chart according to another embodiment of a sustain discharge circuit of the plasma display of FIG. 3.

In addition, even though the signal timing of the sustain discharge circuit of FIG. 4 is changed to the signal timing shown in FIG. 6, the energy recovery ratio can be improved.

Figure 7A:
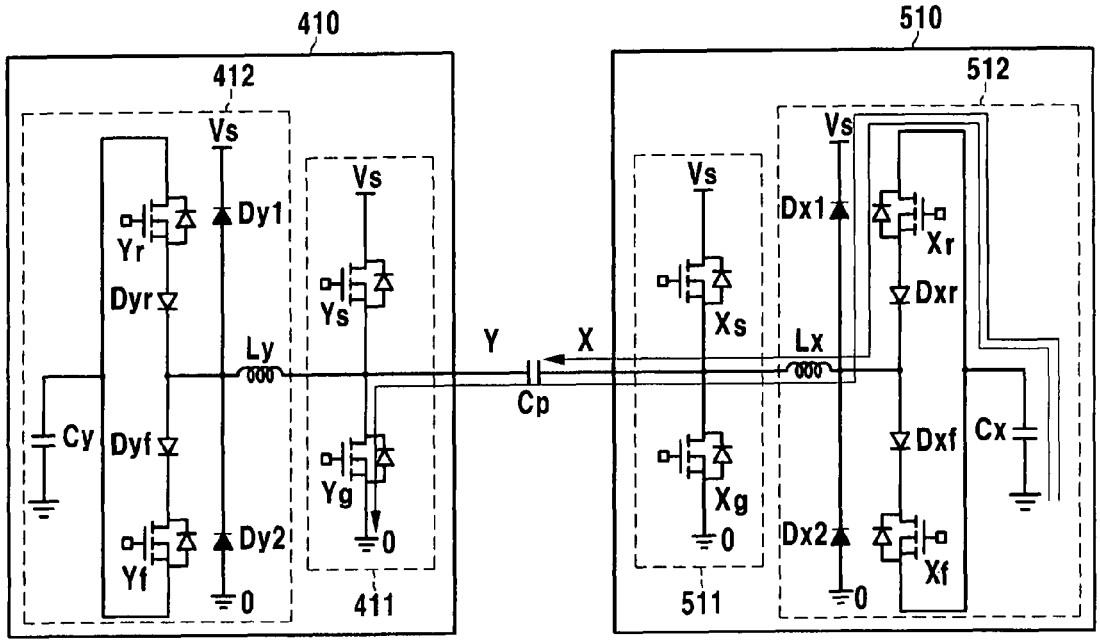
FIGS. 7A and 7B are views to explain the operation of a sustain discharge circuit of the plasma display of FIG. 3 according to the signal timing of FIG. 6.
Figure 7B:
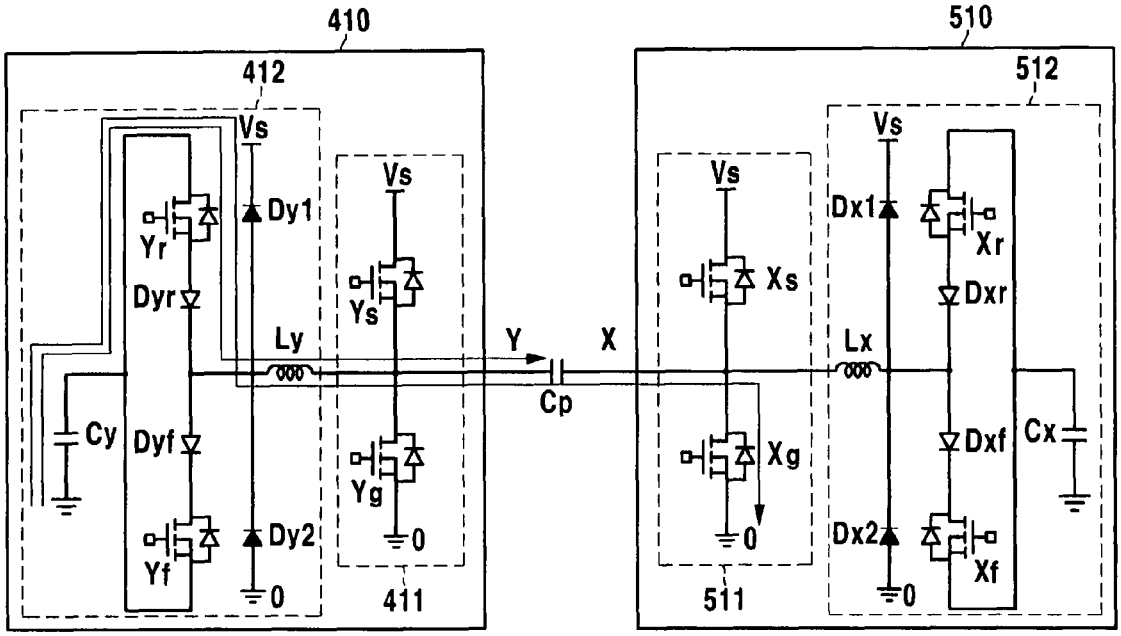

FIG. 6 is a signal timing chart according to another exemplary embodiment of the sustain discharge circuit of the plasma display of FIG. 3, and FIGS. 7A and 7B are views to explain the operation of the sustain discharge circuit of the plasma display of FIG. 3 according to the signal timing of FIG. 6.

⑪ Mode 3' M3' (see FIG. 7A)

In the mode 3' M3' after the mode 2 M2, only the transistor Xr is turned on. As shown in FIG. 7A, a current path ③' is formed through the capacitor Cx, the transistor Xr, the inductor Lx, and the panel capacitor Cp. By this current path, a current flowing through the inductor Lx is increased, and the voltage of the X electrode is increased. Since the Y electrode is in a floating state, if a capacitance exists only between the X electrode and the Y electrode, the voltage of the X electrode has a rapid slope. However, a capacitance exists substantially between the A electrode and the X electrode, and the voltage of the A electrode is fixed during a sustain period. The capacitance of the capacitor that is connected to the X electrode in the mode 3' M3' becomes a capacitance between the A electrode and the X electrode. Furthermore, since a resonance occurs between the capacitor between the A electrode and the X electrode, and the inductor Lx, the voltage of the X electrode does not rapidly increase. In addition, since the Y electrode is in a floating state, the voltage of the Y electrode is also increased, and becomes a voltage larger than the voltage ΔVf.

⑫ Mode 3" M3" (see FIG. 7A)

In the mode 3" M3", when the transistor Xr is turned on, the transistor Yg is turned on. Specifically, in the mode 3' M3', before the voltage of the Y electrode becomes larger than the voltage charged in the capacitor Cx, the transistor Yg is turned on. As shown in FIG. 7A, a current path ③" is formed through the capacitor Cx, the transistor Xr, the diode Dxr, the inductor Lx, the panel capacitor Cp, the transistor Yg, and the ground terminal. At this time, due to impedance in a path formed by the panel capacitor Cp, the transistor Yg, and the ground terminal, the voltage of the Y electrode is decreased with a predetermined slope from a voltage larger than the voltage ΔVf to the voltage 0 V. As such, while the voltage of the Y electrode is decreased from the voltage larger than the voltage ΔVf to the voltage 0 V, a current is supplied to the X electrode through the path of the capacitor Cx, the transistor Xr, the diode Dxr, the inductor Lx, and the panel capacitor Cp, and the current flowing through the inductor Lx is rapidly increased during the corresponding period. Accordingly, when the mode 4 M4 begins in which a voltage of the X electrode is increased due to a resonance occurring between the panel capacitor Cp and the inductor Lx, the inductor Lx has an initial value larger than that in FIG. 4, and thus the voltage of the X electrode can be increased to substantially the voltage Vs in the mode 4 M4. That is, the voltage ΔVr can be further reduced, as compared with the case of FIG. 4.

⑬ Mode 8' M8' (see FIG. 7B)

In the mode 8' M8' after the mode M7, only the transistor Yr is turned on. As a result, as shown in FIG. 7B, a current path ⑧' is formed through the capacitor Cy, the transistor Yr, the inductor Ly, and the panel capacitor Cp. By this current path, a current flowing through the inductor Ly is increased, and the voltage of the Y electrode is increased. Since the X electrode is in a floating state, if a capacitance exists only between the X electrode and the Y electrode, the voltage of the Y electrode has a rapid slope. However, a capacitance exists substantially between the A electrode and the Y electrode, and the voltage of the A electrode is fixed during the sustain period. In the mode 8' M8', the capacitance of the capacitor that is connected to the Y electrode becomes a capacitance between the A electrode and the Y electrode, and a resonance occurs between the capacitor between the A electrode and the Y electrode, and the inductor Ly. Therefore, the voltage of the Y electrode does not rapidly increase. In addition, since the X electrode is in a floating state, the voltage of the X electrode is also increased, and the voltage of the X electrode becomes a voltage larger than the voltage ΔVf. Since the X electrode is in a floating state, the voltage of the X electrode is also increased, and the voltage of the X electrode becomes a voltage larger than the voltage ΔVf.

(14) Mode 8" M8" (see FIG. 7B)

In the mode 8" M8", when the transistor Yr is turned on, the transistor Xg is turned on. As a result, as shown in FIG. 7B, a current path (3)" is formed through the capacitor Cy, the transistor Yr, the diode Dyr, the inductor Ly, the panel capacitor Cp, the transistor Xg, and the ground terminal. Due to impedance in the path formed by the panel capacitor Cp, the transistor Xg, and the ground terminal, the voltage of the X electrode is decreased from a voltage larger than the voltage ΔVf to the voltage 0 V with a predetermined slope. As such, while the voltage of the X electrode is decreased from the voltage larger than the voltage ΔVf to the voltage 0 V, a current is supplied to the Y electrode through the path of the capacitor Cy, the transistor Yr, the diode Dyr, the inductor Ly, and the panel capacitor Cp, and the current flowing through the inductor Lx is continuously increased during the corresponding period. Accordingly, when the mode 9 M9 begins in which a voltage of the Y electrode is increased due to the resonance occurring between the panel capacitor Cp and the inductor Ly, the inductor Ly has an initial value larger than that in FIG. 4. As a result, the voltage of the Y electrode can be increased to substantially the voltage Vs in the mode 9 M9. That is, the voltage ΔVr can be further decreased, as compared with the case of FIG. 4.

In addition, except for the mode 3' M3', the mode 3" M3", the mode 8' M8', and the mode 8" M8", the other modes M1, M2, M4, M5, M6, M7, M9, and M10 are the same as those in FIG. 4. During the sustain period, the sustain discharge circuit repeatedly performs the operations of the modes 1 to 10 M1 to M10 of FIG. 6 by the number of times according to a weight value of the corresponding subfield. Accordingly, a sustain pulse having alternately the voltage 0 V and the voltage Vs is supplied to the Y electrode, and the sustain pulse having alternately the voltage 0 V and the voltage Vs is supplied to the X electrode with a phase opposite to that of the sustain pulse supplied to the Y electrode.

According to the exemplary embodiments of the present invention, when an energy recovery circuit is used during a sustain period, an energy recovery ratio can be improved.

While the present invention has been described in connection with what is presently considered to be practical exemplary embodiments, it is to be understood that the present invention is not limited to the disclosed embodiments, but, on the contrary, is intended to cover various modifications and equivalent arrangements included within the spirit and scope of the appended claims.

What is claimed is:

1. A method of driving a plasma display including first and second electrodes, the method comprising the steps in the order of:

decreasing, in a sustain period, a voltage of the first electrodes from a first voltage;

maintaining the voltage of the first electrodes at a second voltage smaller than the first voltage;

increasing a magnitude of a current flowing through a first inductor connected to the second electrodes while simultaneously changing the voltage of the first electrodes from the second voltage to a third voltage smaller than the second voltage;

increasing a voltage of the second electrodes through the first inductor while supplying the third voltage to the first electrodes;

decreasing the voltage of the second electrodes from a fourth voltage;

maintaining the voltage of the second electrodes at a fifth voltage smaller than the fourth voltage;

increasing a magnitude of a current flowing through a second inductor connected to the first electrodes while decreasing the voltage of the second electrodes from the fifth voltage to a sixth voltage; and increasing the voltage of the first electrodes through the second inductor while supplying the sixth voltage to the second electrodes.

2. The method of claim 1, wherein increasing the magnitude of the current flowing through the first inductor connected to the second electrodes while changing the voltage of the first electrodes from the second voltage to a third voltage smaller than the second voltage comprises increasing the voltage of the second electrodes through the first inductor.

3. The method of claim 2, wherein maintaining the voltage of the first electrodes at a second voltage smaller than the first voltage comprises floating the first electrodes.

4. The method of claim 1, wherein:

during decreasing the voltage of the first electrodes from the first voltage and the maintaining the voltage of the first electrodes at the second voltage smaller than the first voltage, the voltage of the second electrodes is maintained at the sixth voltage; and during decreasing the voltage of the second electrodes from a fourth voltage and the maintaining the voltage of the second electrodes at the fifth voltage smaller than the fourth voltage, the voltage of the first electrodes is maintained at the third voltage.

5. The method of claim 1, wherein each of maintaining the voltage of the first electrodes at the second voltage smaller than the first voltage and the maintaining the voltage of the second electrodes at the fifth voltage smaller than the fourth voltage comprises floating the first and second electrodes.

6. The method of claim 1, further comprising:

supplying the fourth voltage to the first electrodes when the voltage of the second electrodes is maintained at the third voltage, after increasing the voltage of the second electrodes through the first inductor while supplying the third voltage to the first electrodes; and supplying the first voltage to the second electrodes when the voltage of the first electrodes is maintained at the sixth voltage, after increasing the voltage of the first electrodes through the second inductor while supplying the sixth voltage to the second electrodes.

7. The method of claim 1, wherein the third voltage is the same as the first voltage, and the first voltage is the same as the fourth voltage.

8. An apparatus to drive a plasma display including first and second electrodes and performing a display operation, the apparatus comprising:

a first transistor connected between a first power supply supplying a first voltage and the first electrodes;

a second transistor connected between a second power supply supplying a second voltage smaller than the first voltage and the first electrodes;

a first inductor having a first terminal connected to the first electrodes;

a third transistor connected between a second terminal of the first inductor and a third power supply supplying a third voltage between the first voltage and the second voltage, and forming a path to decrease the voltage of the first electrodes upon being turned on;

a second inductor having a first terminal connected to the second electrodes; and a fourth transistor connected between a second terminal of the second inductor and a fourth power supply supplying a fourth voltage having an amplitude between the first voltage and the second voltage, and forming a path to increase the voltage of the second electrodes upon being turned on;

wherein, when a fifth voltage smaller than the third voltage is supplied to the first electrodes, the fourth transistor is turned on simultaneously during a first period when the voltage of the first electrodes is changed to the second voltage.

9. The apparatus of claim 8, wherein the second transistor is turned on during the first period.

10. The apparatus of claim 8, wherein the first electrode is floated during a second initial interval of the first period, and the second transistor is turned on during other intervals of the first period.

11. The apparatus of claim 8, wherein:

the second and fourth transistors are turned on during a third period after the first period, and the voltage of the first electrodes is increased through a path formed by the third power supply, the second inductor, and the second electrodes during the third period.

12. The apparatus of claim 9, further comprising:

a fifth transistor connected between the first power supply and the second electrodes;

wherein, during a fourth period after the third period, the second and fifth transistors are turned on.

13. The apparatus of claim 10, further comprising:

a sixth transistor connected between the second power supply and the second electrodes;

wherein the voltage of the first electrodes is maintained at the third voltage by floating the first and second electrodes, after turning on the third and sixth transistors prior to maintaining the voltage of the first electrodes.

14. The apparatus of claim 11, further comprising:

a seventh transistor connected between a second terminal of the second inductor and the third power supply, and forming a path to decrease the voltage of the second electrodes upon being turned on; and an eighth transistor connected to the second terminal of the first inductor and the fourth power supply, and forming a path to increase the voltage of the first electrodes upon being turned on;

wherein, when a sixth voltage smaller than the fourth voltage is supplied to the second electrodes, the eighth transistor is turned on during a fifth period when the voltage of the second electrodes is changed to the second voltage.

15. The apparatus of claim 12, wherein the second voltage is supplied to the second electrodes while supplying the first voltage to the first electrodes, and the first voltage is supplied to the second electrodes while supplying the second voltage to the first electrodes.

16. A method of driving a plasma display including first and second electrodes, the method comprising the steps in the order of:

during a sustain period, decreasing a voltage of the second electrodes to a second voltage larger than a first voltage through a first inductor connected to the second electrodes when a voltage of the first electrodes is maintained at the first voltage;

accumulating energy in a second inductor connected to the first electrodes while simultaneously decreasing the voltage of the second electrodes from the second voltage to the first voltage;

increasing the voltage of the first electrodes to a third voltage through the second inductor when the voltage of the second electrodes is maintained at the first voltage;

decreasing the voltage of the first electrodes from the third voltage to a fourth voltage larger than the first voltage through the second inductor when the voltage of the second electrodes is maintained at the first voltage;

accumulating energy in the first inductor connected to the second electrodes while decreasing the voltage of the first electrodes from the fourth voltage to the first voltage; and increasing the voltage of the second electrodes to the third voltage through the first inductor when the voltage of the first electrodes is maintained at the first voltage.

17. The method of claim 16, further comprising floating the first and second electrodes at least during one period occurring:

floating the second electrode between decreasing a voltage of the second electrodes to a second voltage larger than a first voltage through a first inductor connected to the second electrodes when a voltage of the first electrodes is maintained at the first voltage and accumulating energy in a second inductor connected to the first electrodes while decreasing the voltage of the second electrodes from the second voltage to the first voltage; and floating the first electrode between decreasing the voltage of the first electrodes from the third voltage to a fourth voltage larger than the first voltage through the second inductor when the voltage of the second electrodes is maintained at the first voltage and accumulating energy in the first inductor connected to the second electrodes while decreasing the voltage of the first electrodes from the fourth voltage to the first voltage.

18. The method of claim 16, further comprising:

supplying the third voltage to the first electrodes when the voltage of the second electrodes is maintained at the first voltage, after increasing the voltage of the first electrodes to the third voltage through the second inductor when the voltage of the second electrodes is maintained at the first voltage; and supplying the third voltage to the second electrodes when the voltage of the first electrodes is maintained at the first voltage, after the increasing the voltage of the second electrodes to the third voltage through the first inductor when the voltage of the first electrodes is maintained at the first voltage.

* * * * *